US008016351B2

(12) United States Patent
Cassaday

(10) Patent No.: US 8,016,351 B2
(45) Date of Patent: Sep. 13, 2011

(54) CHAIR WITH ONBOARD ELECTRICAL POWER SOURCE

(76) Inventor: Terry Cassaday, Toronto (CA)

( * ) Notice: Subject to any disclaimer, the term of this patent is extended or adjusted under 35 U.S.C. 154(b) by 0 days.

(21) Appl. No.: 10/525,569

(22) PCT Filed: Jul. 22, 2003

(86) PCT No.: PCT/CA03/01047

§ 371 (c)(1),
(2), (4) Date: Feb. 25, 2005

(87) PCT Pub. No.: WO2004/017798

PCT Pub. Date: Mar. 4, 2004

(65) Prior Publication Data

US 2005/0242635 A1 Nov. 3, 2005

(30) Foreign Application Priority Data

Aug. 26, 2002 (CA) ..... 2399823

(51) Int. Cl.
*A47C 7/62* (2006.01)

(52) U.S. Cl. ..... 297/217.1; 297/217.3

(58) Field of Classification Search ..... 297/217.3, 297/217.1; 136/291; 180/65.1, 907
See application file for complete search history.

(56) References Cited

U.S. PATENT DOCUMENTS

| | | | | | |
|---|---|---|---|---|---|
| 2,310,346 | A * | 2/1943 | Bell | 248/408 |
| 2,838,095 | A * | 6/1958 | Deaton | 297/301.4 |
| 4,779,922 | A * | 10/1988 | Cooper | 297/188.21 |
| 4,933,618 | A * | 6/1990 | Ortlieb | 318/640 |
| 5,329,716 | A * | 7/1994 | Fite | 40/575 |
| 5,523,664 | A * | 6/1996 | Ogasawara | 318/590 |
| 5,544,671 | A * | 8/1996 | Phillips | 135/88.14 |
| 5,893,608 | A * | 4/1999 | Cravenor | 297/217.3 |
| 5,944,384 | A * | 8/1999 | Patterson | 297/344.23 |
| 5,975,630 | A * | 11/1999 | Schreiber | 297/217.3 |
| 6,000,353 | A * | 12/1999 | De Leu | 114/61.1 |
| 6,204,767 | B1 * | 3/2001 | Sparks | 340/573.1 |
| 6,393,348 | B1 * | 5/2002 | Ziegler et al. | 701/45 |
| 6,749,257 | B2 * | 6/2004 | Muller | 297/217.3 |
| 6,855,016 | B1 * | 2/2005 | Jansen | 440/6 |
| 6,870,477 | B2 * | 3/2005 | Gruteser et al. | 340/573.1 |
| 2001/0045763 | A1 * | 11/2001 | Jacoway | 297/16.1 |
| 2002/0056709 | A1 * | 5/2002 | Burt | 219/217 |

* cited by examiner

*Primary Examiner* — Sarah B McPartlin

(57) ABSTRACT

A chair (1), bed, lounge or other similar type structure has electrical functions or features and also has an energy converter (21, 9, 59) which produces electrical power from conditions to which the structure is exposed on a regular basis to power the functions or features.

15 Claims, 6 Drawing Sheets

CHAIR WITH ONBOARD ELECTRICAL POWER SOURCE

FIELD OF THE INVENTION

The present invention relates to a chair or bed or lounge having features requiring electrical power and also having an energy converter to power the electrical features.

BACKGROUND OF THE INVENTION

Newly developed high tech chairs have numerous adjustments for different parts of the chairs. The adjustments are made by manually operated controls. There is essentially no development with respect to electrically operated features in a chair. This is because according to current chair design, these features would have to be powered by either plugging the chair into an AC outlet or through the use of a rechargeable battery of the type that would have to be removed from the chair for recharging purposes.

SUMMARY OF THE PRESENT INVENTION

The present invention relates to chair, lounge or bed member having electrical power requiring features and also having its own onboard power source for powering those features. The onboard power source is in the form of an energy converter which converts energy to which the member is exposed on a regular basis to electrical energy to meet the electrical requirements of the member.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Before going into specific details with respect to the drawings it should be noted that each of the following embodiments includes energy conversion means to convert energy to which a chair, bed or lounge member is exposed into electrical power for operating electrical power requiring features of the chair, bed or lounge member. This energy conversion means typically takes one of two forms. One of those forms comprises a solar panel which picks up energy from ambient light to which the member is exposed and converts the ambient light to energy for the chair. The electrical energy from the ambient light can be converted and stored in a storage unit for use as required. It can also be converted and used without storage for immediate requirements of the chair.

In another form, the energy conversion means comprises a power generator which converts different chair motions into the electrical energy for storage or for immediate use.

Specific examples with respect to all of the above features are now described with respect to FIGS. 1 through 6 of the drawings.

Figure 1:
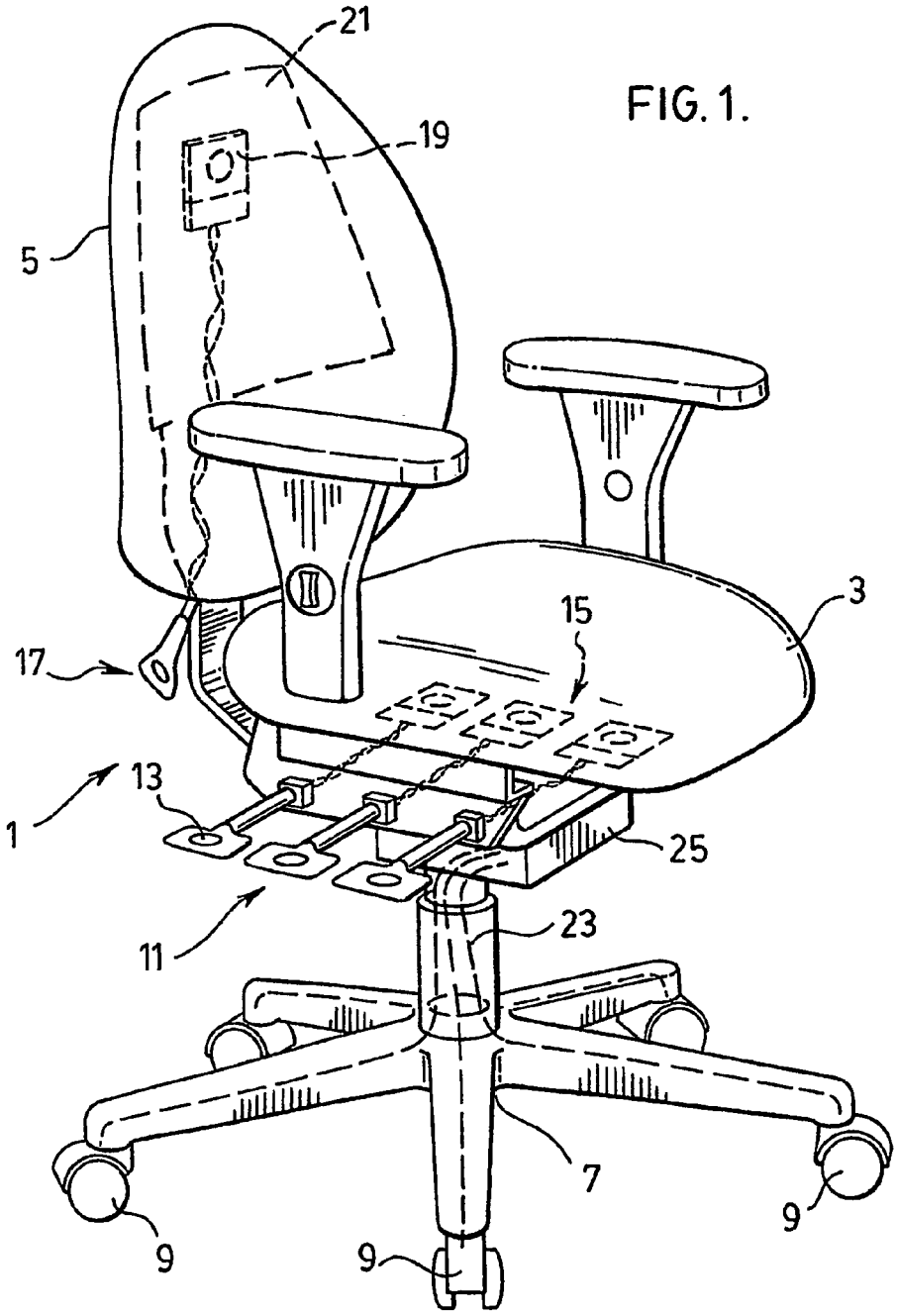
FIG. 1 is a perspective view of a chair provided with electrical power requiring controls and energy conversion means for operating those controls according to a preferred embodiment of the present invention.

FIG. 1 shows a chair generally indicated at 1. This chair has a chair seat 3 and a chair back 5. It is supported by a pedestal base 7 having rolling casters 9. Chair 1 has a plurality of chair movement controls generally indicated at 11. These controls are provided with sensors 13. Activation of the sensors produces audible directions for use of the controls through a series of voice chips generally indicated at 15. These voice chips include their own small speakers to enable a person sitting in the chair to hear the chair control directions.

A further sensor provided control 17 operates a speaker voice chip 19 embedded in back of the chair.

Each of the voice chips 15 and 19 with associated speakers as well as the sensors at the controls require electrical power for their operation. This electrical power is provided through a power storage pack 25 located beneath the chair seat 3.

Power storage pack 25 receives its power by two separate energy conversion means provided onboard of the chair. One of those energy conversion means comprises a solar panel 21 supported on the rear surface of the chair back 5. Solar panel 21 receives energy from ambient light to which the chair is exposed. This energy is converted by the solar panel to electrical energy which is stored in the storage pack 25 for use as required.

The second form of energy conversion means is provided by the rolling casters 9 on the pedestal base 7 of the chair. These rolling castors act as small generators as the chair is moved across the floor on which the chair is supported in everyday usage conditions. The generator therefore converts the energy from the movement of the chair to electrical energy which is again stored through wires 23 in storage pack 25.

Storage pack 25 outputs the energy stored in it to the different chair controls only when the controls are operated by the user of the chair.

As will be appreciated from the description above, storage pack 25 operates somewhat similar to a rechargeable battery. However, unlike conventional rechargeable batteries the storage pack does not need to be removed from the chair nor does the chair have to be electrically connected to an A.C. outlet to recharge the storage pack. In contrast, either the ambient light around the chair and/or the motion of the chair provides a recharging of the power pack.

Figure 2:
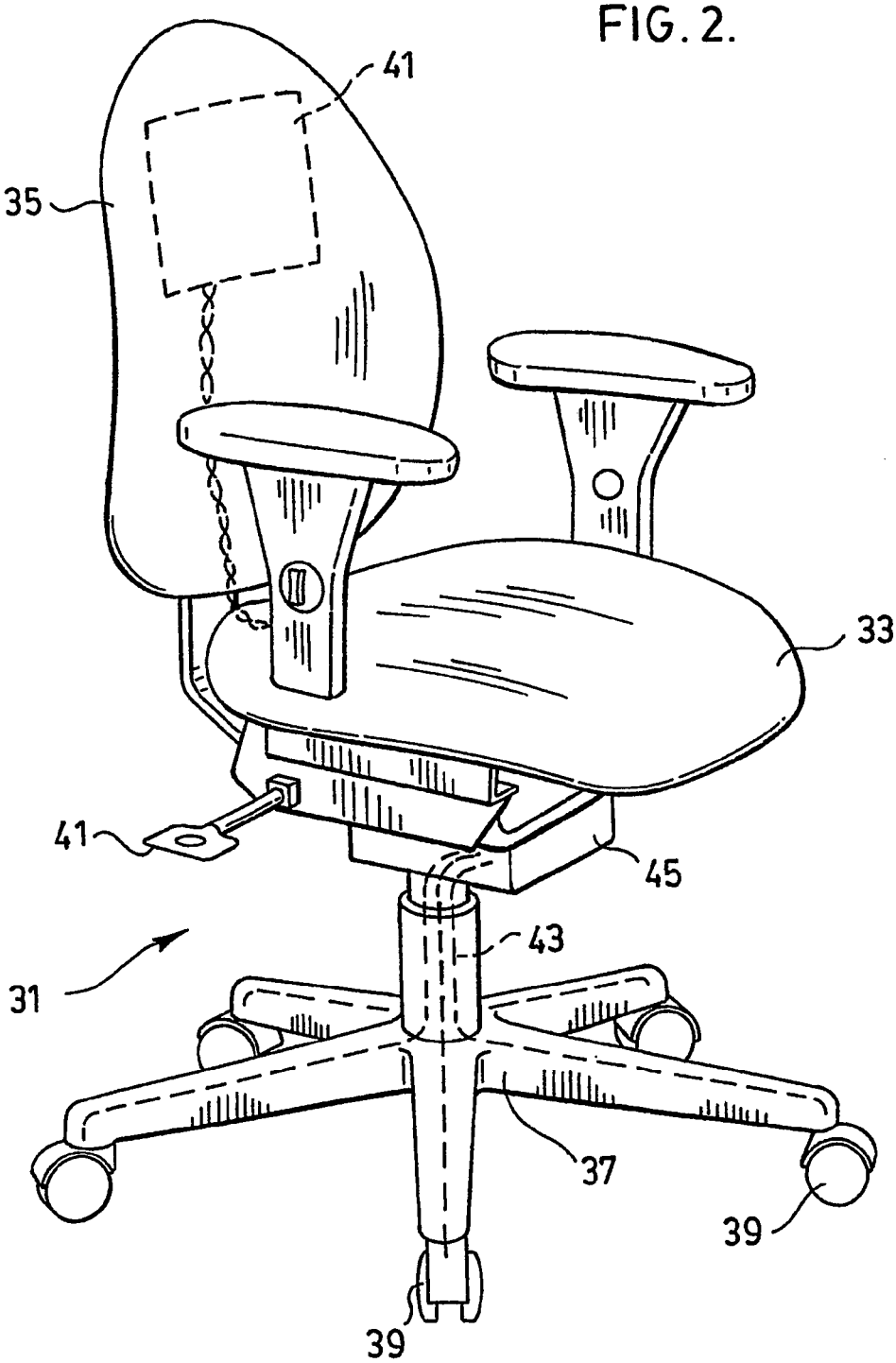
FIG. 2 is a perspective view of another chair having an electrical operation feature and energy conversion means for the chair operation feature according to another preferred embodiment of the present invention.

FIG. 2 shows another embodiment of the invention. In this embodiment, an office type chair generally indicated at 31 has a seat 33 and a chair back 35. The chair is supported by a pedestal base 37 having rolling casters 39.

According to this particular embodiment, a control 41 is provided for an electrical seat height and back height adjustment of the chair. The electrical power required for the adjustment and/or for the electromagnetic locking of the adjustments is provided by means of a power pack 45. The onboard energy converters to charge and recharge power pack 45 are in the form of a solar panel 41 on the rear surface of the chair back and power generators formed by the rolling casters 39 which are wired as indicated at 43 to power pack 45.

Figure 3:
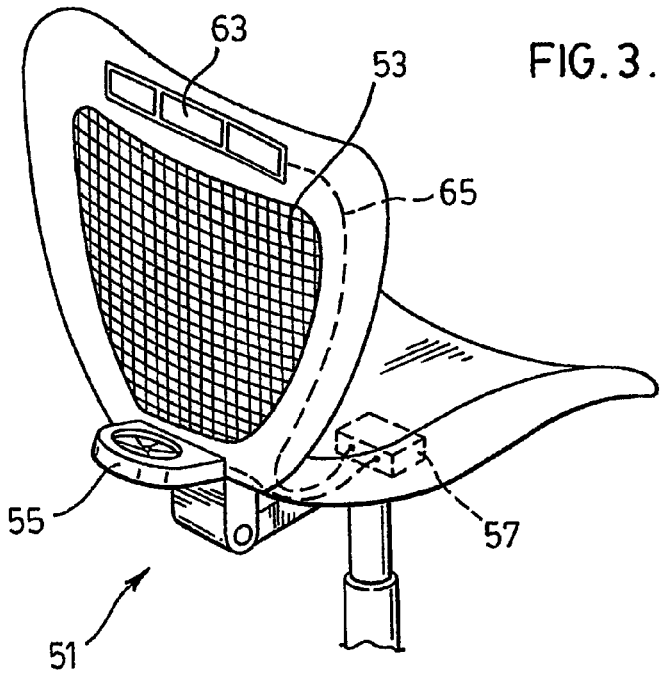
FIG. 3 is a perspective view of a further chair with another electrically operated feature and energy conversion means to power that feature according to another preferred embodiment of the present invention.

FIG. 3 shows another embodiment of the invention. In particular, FIG. 3 shows the upper region of a chair generally at 51. This chair has an open mesh ventilated region generally indicated at 53 through the back of the chair. Provided to the rear of the chair is a blower 55. A power pack 57 is provided beneath the chair seat for operation of blower 55.

As will be appreciated from FIG. 3 blower 55 is able to provide a flow of cooling air through the ventilated region 53 in the chair back to a person sitting in the chair.

Power pack 57 is charged and recharged by means of an energy converting solar panel 63 wired at 65 to the power pack.

Figure 4:
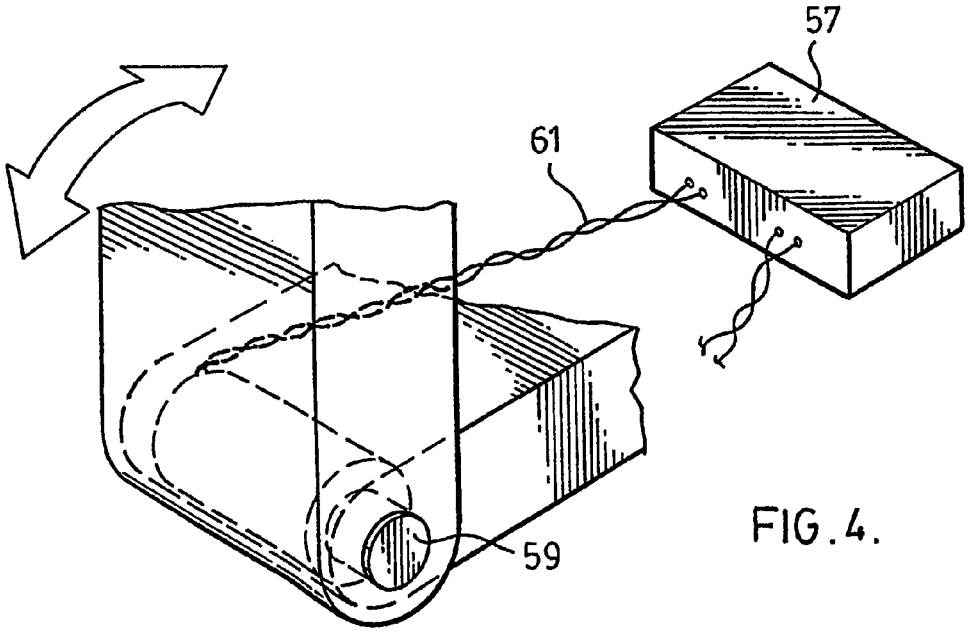
FIG. 4 is an enlarged perspective view of one of the energy converters to provide the electrical power for the chair of FIG. 3.

FIG. 4 of the drawings shows the power pack 57 is additionally provided with converted energy by means of a hinged joint 59 between the chair seat and the chair back. This hinged joint acts as a generator and converts rocking motions between the chair seat and the chair back to electrical energy which is stored in power pack 57.

Another area in the chair particularly suited to receive a similar type of power generator is at the upper end of the pedestal chair base. At this position there is often a substantial rocking motion between the chair base and the body of the chair formed by the chair seat and chair back.

Figure 5:
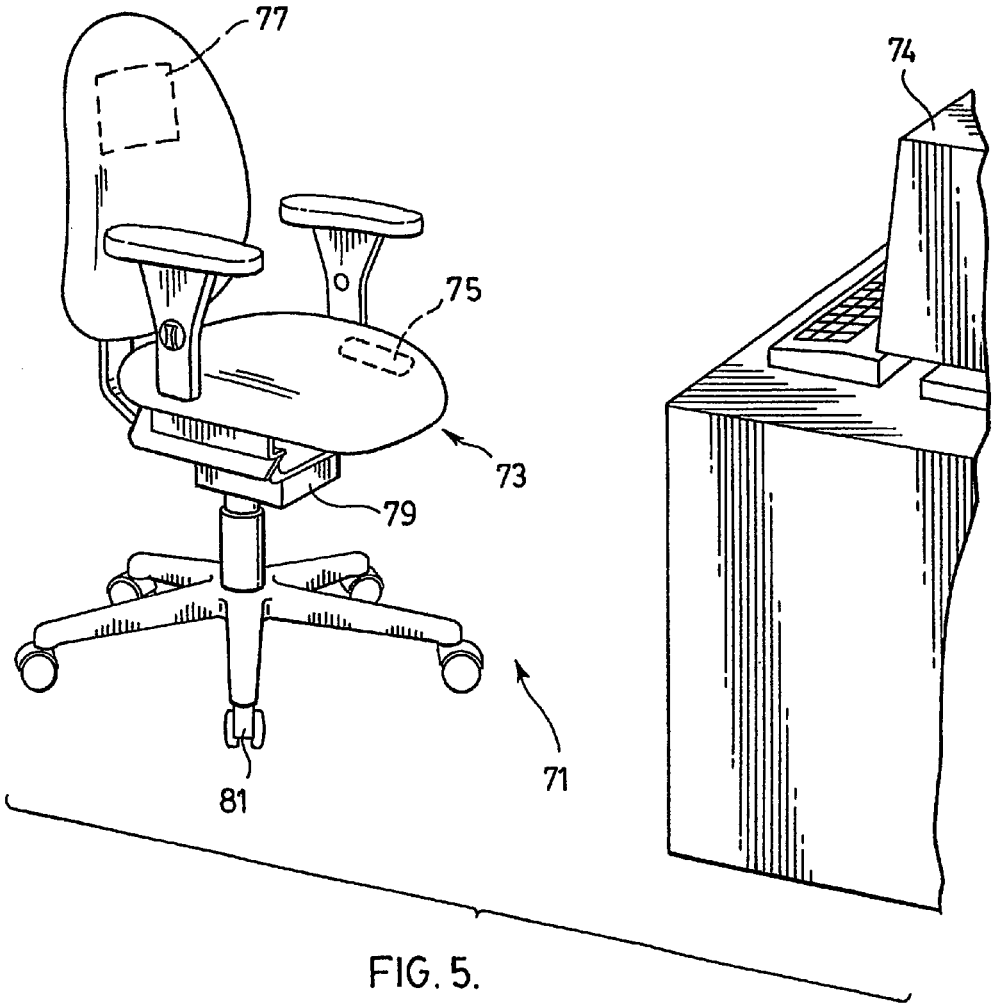
FIG. 5 is a perspective view of a chair with electrical power requirements and energy conversion means for meeting those requirements according to still a further preferred embodiment of the present invention.

FIG. 5 of the drawings shows yet another embodiment of the invention. In particular, FIG. 5 shows an overall chair system generally indicated at 71. This chair system comprises the actual chair 73 and a computer monitor 74.

Chair 73 is provided with a sensor 75 electrically powered by a power pack 79. Power pack 79 is charged by energy converting solar panel 77 on the rear surface of the chair back. It is also charged by means of power generating rolling casters 81 which support the chair.

Sensor 75 is positioned within the chair seat immediately beneath its upholstered surface in a position where it picks up the biorhythms such as heart rate, blood pressure etc. of a person seated in the chair. These biorhythms are particularly easily picked up at the under surface of a person's thigh which would locate directly over sensor 75 when a person is sitting in the chair.

However, the sensor could easily be located in other areas of the chair such as the armrest, the chair back etc. where the biorhythms could be picked up. The biorhythms that are sensed by sensor 75 are then displayed at monitor 77. The chair can either be hard wired to the monitor to feed the output of the sensor to the monitor or the sensor preferably transmits air born signals to a receiver of the monitor.

Figure 6:
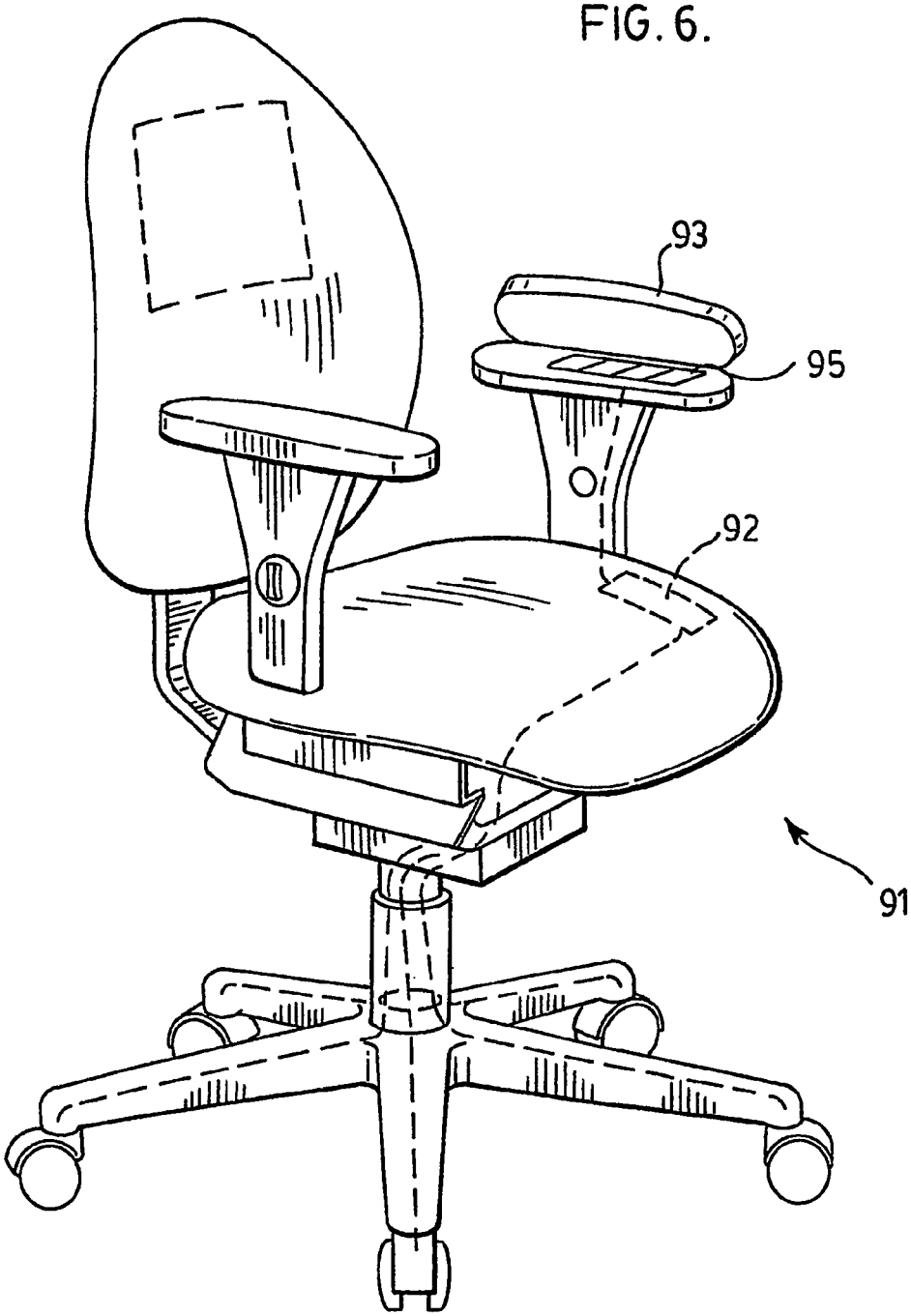
FIG. 6 is a perspective view of an electrically powered chair according to yet another preferred embodiment of the present invention.

FIG. 6 shows a chair 91 which is slightly different from the chair 71 shown in FIG. 5. According to FIG. 6 chair 91 includes a biorhythm sensor 92 which is wired directly to a display 95 provided in the chair armrest. This display is normally covered by a hinged upholstered armrest cover 93 which opens to the FIG. 6 position to allow a viewing of display 95. When it is not desired to see the display the top cover 93 of the armrest hinges downwardly to a position where it covers the display and provides a comfortable resting area for the arm of a person using the chair.

Both the sensor 92 and the display 95 are powered by means of a power pack 96 beneath the chair seat. Power pack 96 is charged by a solar panel on the back of the chair and by the power generating castors supporting the chair.

Either of the chair embodiments of FIGS. 5 and 6 are easily modified to once again include a small speaker powered by the chair to provide an audible report of the biorhythm feedback of a person using the chair. This speaker can be the same one as used for the controls or it can be a separate speaker specifically for the biorhythm feedback.

Figure 7:
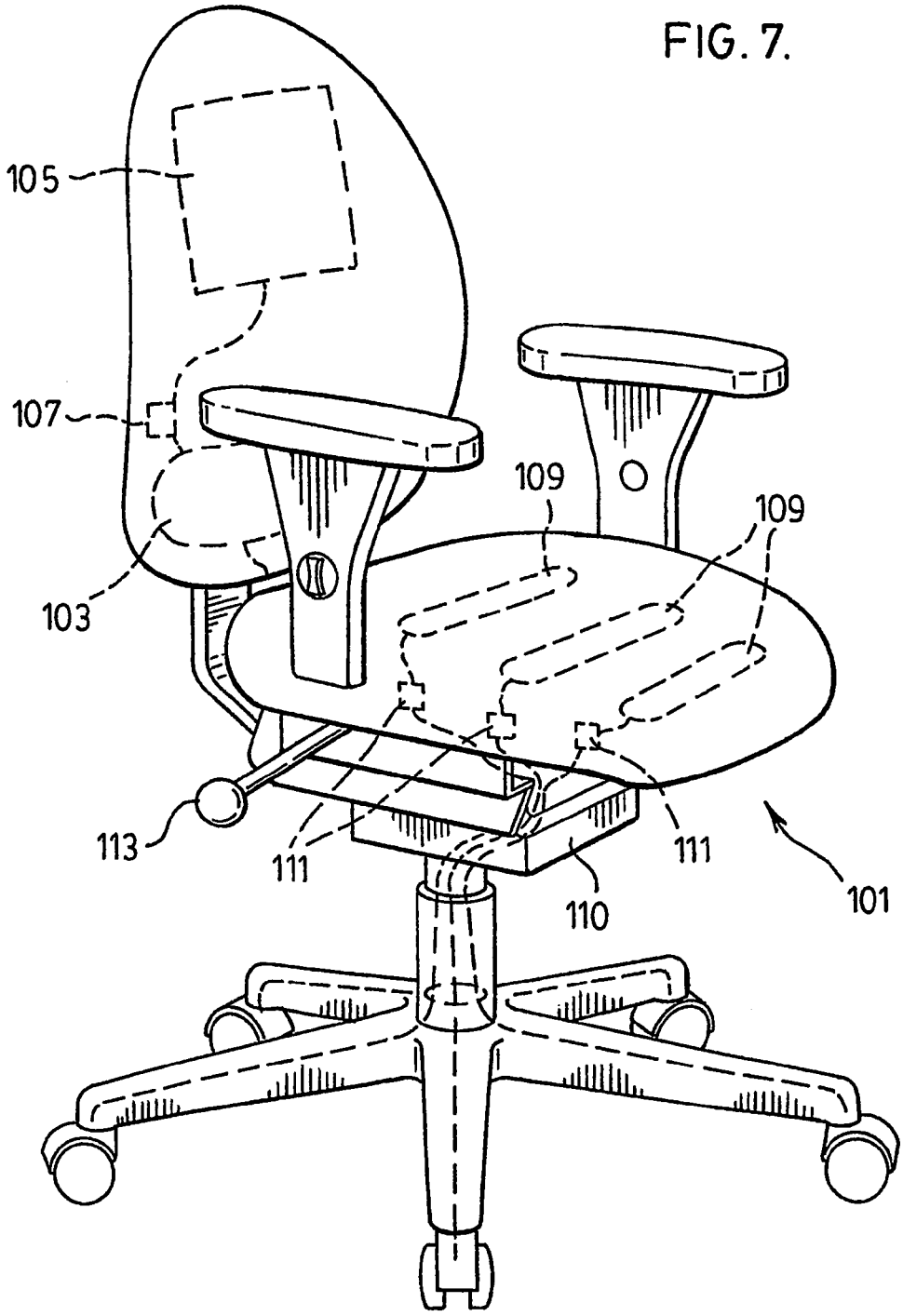
FIG. 7 is a perspective view of a chair having electrical power requirements according to yet another preferred embodiment of the invention.

FIG. 7 shows another preferred embodiment chair generally indicated at 101. This chair includes adjustable lumbar support 103 and a plurality of combination vibrator heaters 109.

Lumbar support 103 is powered by solar panel 105. The energy converted by the solar panel to provide electrical power for the lumbar support feeds through a timer 107.

Solar panel 105 also powers energy storage pack 110 which can be used to draw energy for the electrically operated lumbar support. Power pack 110 also draws energy from different rocking motions of the chair.

The combination heater vibrators 109 are connected to power pack 110 through electrical timers 111.

Chair 101 has a number of different functions. For example, it has been determined that it is important that people do not assume a stagnant or non-moving position for extended periods of time. Accordingly, lumbar support 103 through timer 107 provides an automatic body position adjustment for someone using the chair at specific timed intervals. The lumbar support can expand and then collapse at regular timed intervals causing a person using the chair to re-adjust his or her back position with expansion and contraction of the lumbar support. The power for producing the expansion and contraction of the lumbar support is provided through solar panel 105 and/or storage pack 110.

The vibrators 109 which can equally as well be provided in the seat back of the chair provide at timed intervals stimulus to improve blood circulation of a person using the chair. The added affect of the heat which can be operated separately of or in conjunction with the vibration further increases blood flow.

Again the powering for the vibrating heaters is provided by solar panel 105 converting electrical energy to be fed either directly to elements 109 or through storage pack 110 and timers 111 to the vibrating heating elements.

As a further preferred feature a controller 113 is provided which overrides all of the timed out functions to provide when desired instantaneous operation of either the adjustable lumbar support and/or the vibrating heating elements.

Some of the embodiments described above for example, the ventilation and height adjustment features of the chair require relatively high power in comparison to other embodiments of the chair such as biorhythm monitors and digital displays. The embodiments of the chair which do require higher power will include a larger solar panel and possibly all of the power generators described above. In the case of an embodiment requiring lower power it may not be necessary to include things such as additional generators nor may the actual power pack be required. For example, the instantaneous energy conversion provided by the solar panel on the back of the chair is likely sufficient to power something such as small sensor or even the display for the sensor. Furthermore, the display itself may include its own solar converter for powering the display.

All of the description above relates to the provision of electrically powered features and means for supplying rechargeable power to those features in a chair and specifically an office chair. It is to be appreciated that the same or at least similar features can be provided in a bed or lounge. Of particular interest, is a hospital bed which often has numerous controls for positioning of the bed. Furthermore, separate heart rate monitors etc. are often used in conjunction with hospital beds. In accordance with the present invention, the hospital bed controls are operated by a power source carried by the bed and charged by onboard energy converters such as the solar panels and generators described in association with the embodiments of FIGS. 1 through 6 of the drawings. Furthermore, a hospital bed built in accordance with the present invention can include its own onboard heart rate monitor or similar biorhythm testing device which is once again powered by the onboard power supply and energy converter of the hospital bed.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A member selected from the group of members consisting of a chair member, a bed member and a lounge member, said member including an information output device which outputs information from said member, an energy converter which converts energy to which the member is exposed to electrical energy for powering said information output device, wherein said information output device comprises a plurality of physical movement controls mounted on said member for moveable parts of said member, each said physical movement control including a sensor means to activate said information output device for outputting information to an occupant of the member regarding the directions of use of said physical movement control without producing the movements of the member.

2. A member as claimed in claim 1 wherein said energy converter comprises a solar panel provided on an exposed surface of said member.

3. A member as claimed in claim 1 wherein said information output circuitry is further linked to a biorhythm sensor.

4. A member as claimed in claim 3 including a digital display also powered by said energy converter and displaying information from said biorhythm sensor.

5. A member as claimed in claim 1 wherein said member comprises a chair and said energy converter converts motion of a moveable portion of the chair to electrical energy.

6. A member as claimed in claim 1 wherein said information output device provides audio feedback providing the directions for use of said physical movement control.

7. A member as claimed in claim 6 including a visual display also powered by said energy converter, said visual display visually displaying information to an occupant of the member regarding the directions for use of said physical movement control upon activation of said sensor means.

8. A member as claimed in claim 1 including an electrical rechargeable power pack which is charged by said energy converter, said power pack storing the electrical energy and dispersing the electrical energy as required.

9. A chair as claimed in claim 8 wherein said electrical rechargeable power pack is a rechargeable battery carried by said member, and said energy converter recharges said rechargeable battery.

10. A member as claimed in claim 1 wherein said member comprises a chair having rolling casters for generating said electrical energy.

11. A member as claimed in claim 1 wherein said member comprises a chair and said chair has a back and seat and a moveable hinge between said back and seat for generating said electrical energy.

12. A member as claimed in claim 1 further having electrically operated body repositioning means powered by said energy converter, or rechargeable power pack.

13. A member as claimed in claim 12 wherein said member comprises a chair and said body repositioning means comprises a lumbar adjustment member, and said chair further includes an electrically generated timer which provides timed interval repositioning of said lumbar adjustment members.

14. A chair having electrical power requirements for displaying information to an occupant of the chair regarding the operation of a plurality of physical movement controls for moving a plurality of parts respectively of the chair each said physical movement control including activation means for displaying said information regarding the operation of said plurality of physical movement controls without producing movement of said parts comprising:

(a) energy converter means carried by said chair for:

(i) providing power to said physical movement controls and said activation means to move the parts of the chair respectively and to display said information to the occupant regarding directions for the operation of the physical movement controls, without affecting movement of said parts, to inform the occupant to use the physical movement controls to move said parts of the chair respectively; and (ii) providing power to a display for displaying information regarding the directions for operation of said physical movement controls without producing movements of said parts respectively.

15. A member selected from the group of members consisting of a chair member, a bed member, and a lounge member, said member including an information output device which outputs information from said member, an energy converter which converts energy to which the member is exposed to electrical energy for powering said information output device; and a physical movement control mounted on said member for moving a part of said member, said physical movement control including activation means to activate said information output device, said information output device outputting information to an occupant of the member regarding directions of use of said physical movement control without producing the movement of the moveable part.

* * * * *